United States Patent [19]

Ferrara et al.

[11] Patent Number: 4,962,955

[45] Date of Patent: Oct. 16, 1990

[54] DECK LID LATCH AND REMOTE RELEASE

[75] Inventors: Randy Ferrara, Mt. Clemens; Carl D. May, Farmington Hills; Ian J. Dow, Royal Oak, all of Mich.

[73] Assignee: General Motors Corporation, Detroit, Mich.

[21] Appl. No.: 422,398

[22] Filed: Oct. 16, 1989

[51] Int. Cl.[5] ..... E05C 3/26

[52] U.S. Cl. ..... 292/216; 292/DIG. 25; 292/DIG. 43; 292/199; 292/225

[58] Field of Search ..... 292/DIG. 25, DIG. 43, 292/DIG. 14, 216, 225, DIG. 27, 214, 199, 280

[56] References Cited

U.S. PATENT DOCUMENTS 4,478,441 10/1984 Fiordellisi et al. ..... 292/216
4,544,189 10/1985 Fiordellisi et al. ..... 292/DIG. 43
4,702,117 10/1987 Tsutsumi et al. ..... 292/225 X

*Primary Examiner*—Richard E. Moore
*Attorney, Agent, or Firm*—Charles E. Leahy

[57] ABSTRACT

A luggage compartment lid openable upon release of the deck lid latch and a release handle mounted in the operator compartment and connected to the latch by a cable for remotely releasing the latch upon operator actuation of the release handle. A drive gear is rotatably mounted on the latch to release the latch upon rotation of the drive gear. An actuator gear is also rotatably mounted on the latch and has gear teeth meshing with gear teeth of the drive gear. The actuator gear is connected to the cable so that operator actuation of the release handle rotates the actuator gear and the drive gear to release the latch. A shift bar is located inside the luggage compartment and is operable to selectively shaft the actuator gear away from the drive gear so that the gear teeth are disengaged and operator actuation of the release handle is thereby disconnected from the latch so that the deck lid cannot be opened without the use of a key to operate the conventional key cylinder release of the deck lid.

6 Claims, 2 Drawing Sheets

DECK LID LATCH AND REMOTE RELEASE

The invention relates to a remotely releasable latch for a vehicle deck lid and more particularly provides shiftable gear device for disconnecting a remote release handle from the deck lid latch.

Background of the Invention

Motor vehicles typically have a latch for latching a deck lid. The latch may be re)eased by a key cylinder to open the deck lid and permit access to a luggage compartment.

It is also known to provide a remote handle adjacent the operator's seat which is connected to the latch by a cable. Lifting the handle pulls the cable and thereby releases the latch from inside the vehicle so that the deck lid springs to the open position.

One disadvantage of the aforedescribed remote release for the deck lid is that a person who has entry to the occupant compartment, such as a valet parking attendant, also has access to the luggage compartment by operating the remote handle. Accordingly, the prior art has proposed a switching device located inside the luggage compartment by which the remote release may be disenabled from operation of the deck lid latch.

The present invention provides a new and improved remotely releasable deck lid latch having a disconnect device for disenabling the remote release feature.

Summary of the Invention

According to the invention the vehicle has a luggage compartment lid openable upon release of the deck lid latch and a release handle mounted in the operator compartment and connected to the latch by a cable for remotely releasing the latch upon operator actuation of the release handle. A drive gear is rotatably mounted on the latch to release the latch upon rotation of the drive gear. An actuator gear is also rotatably mounted on the latch and has gear teeth meshing with gear teeth of the drive gear. The actuator gear is connected to the cable so that operator actuation of the release handle rotates the actuator gear and the drive gear to release the latch. A shift bar is located inside the luggage compartment and is operable to selectively shift the actuator gear away from the drive gear so that the gear teeth are disengaged and operator actuation of the release handle is thereby disconnected from the latch so that the deck lid cannot be opened without the use of a key to operate the conventional key cylinder release of the deck lid.

Accordingly, the object feature and advantage of the present invention presides in the provision of a gear train connecting the remote release cable with a deck lid latch and shifting the gear train between an engaged position permitting remote cable operation of the deck lid latch and a disengaged position effectively disconnecting the remote cable from the deck lid latch.

Brief Description of the Drawings

These and other objects, features, and advantages of the invention will become apparent upon consideration of the description of the preferred embodiment and the appended drawings in which.

Description of the Preferred Embodiment

Figure 1:
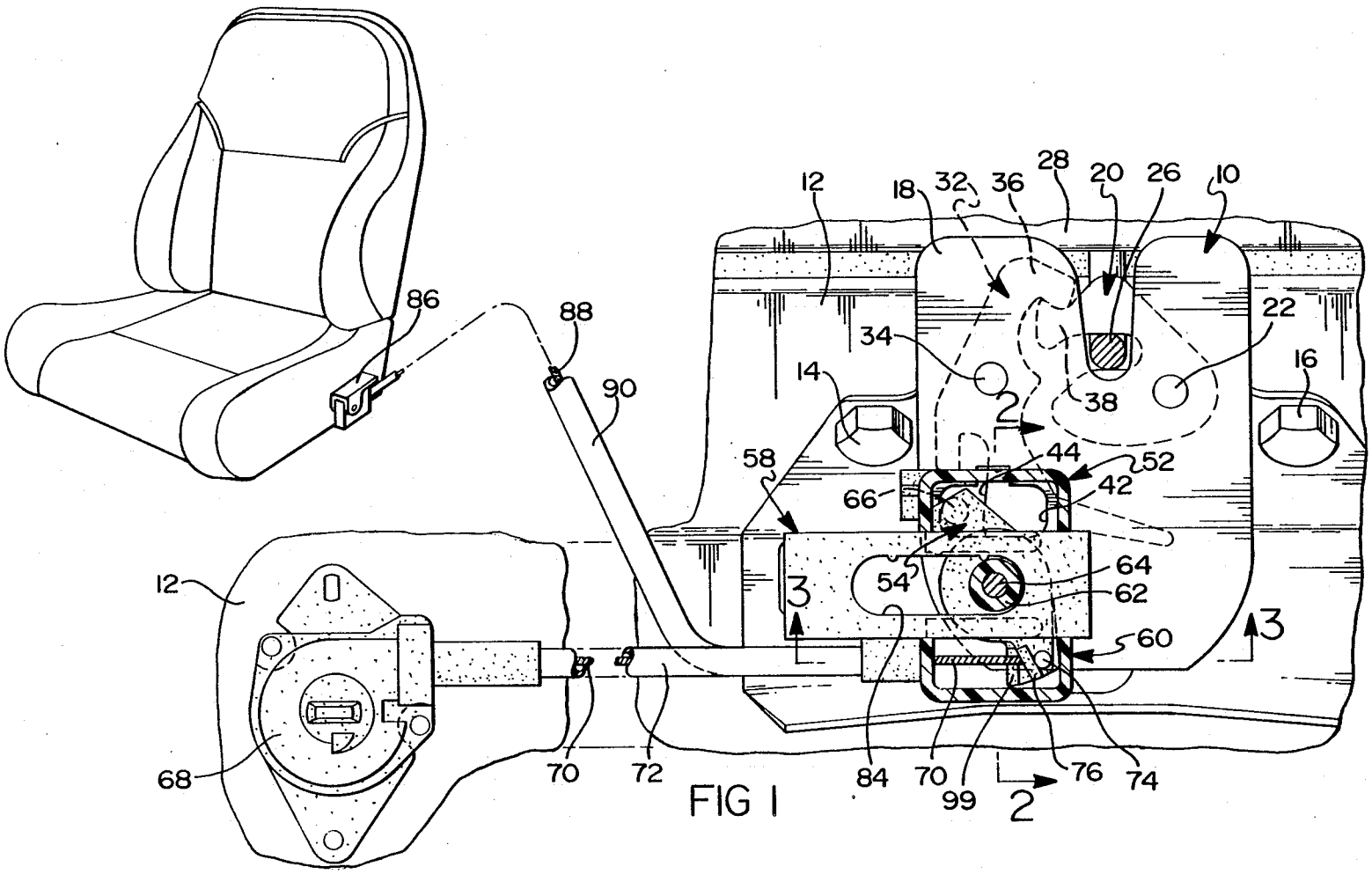
FIG. 1 is a elevation view of the deck lid latch according to the invention.

Referring to FIG. 1, a deck lid latch generally indicated at 10 is mounted on a vehicle body 12 by bolts 14 and 16. The latch 10 includes a latch housing 18 upon which a latch bolt 20 is mounted by a pivot 22. FIG. 1 shows the latch bolt 20 pivoted to its latched position capturing a striker bolt 26 carried by the deck lid 28.

The latch 10 also includes a detent lever 32 pivotally mounted on the latch housing 18 by pivot pin 34. FIG. 1 shows the detent lever 32 in its latched position in which a hook portion 36 of the detent lever 32 engages with a hook portion 38 of the latch bolt 20 to retain the latch bolt 20 at the latched position of FIG. 1. The housing 18 of the latch has a cut out 42 which exposes a abutment face 44 of the detent lever 32.

Figure 2:
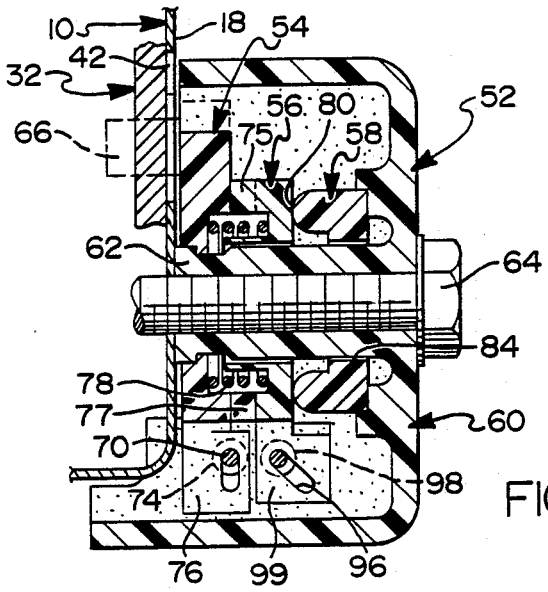
FIG. 2 is a section view taken in the direction of arrows 2—2 of FIG. 1.

A latch operating module 52 is mounted on the latch housing 18 for operating the detent lever 32. As best seen in FIG. 2, the latch operating module is comprised of molded plastic drive gear 54, actuator gear 56, and shift bar 58, enclosed within a molded plastic housing 60. The housing 60 has a central support sleeve 62 which engages latch housing 18 and receives a bolt 64 threaded into the latch housing 18 to mount the housing 60 o n the latch 10.

The molded plastic drive gear 54 is rotatably journaled on the support sleeve 62 and has an operating arm 66 which reaches through the cutout 42 of latch housing 18 as best seen in FIG. 1. A key operated lock cylinder 68 is connected to the drive gear 54 by a cable 70 extending through sheath 72 and having a knob 74 swaged on the end thereof and engaging with a flange 76 of the drive gear 54. Accordingly, as best seen in FIG. 1, rotation of the key cylinder 68 by a properly bitted key will pull the cable 70 leftwardly thereby rotating the drive gear 54 in the clockwise direction of FIG. 1 to cause operating arm 66 to engage abutment 44 of detent lever 32 and rotate the detent lever 32 away from engagement with fork bolt 20 so that the striker 26 is released to permit opening movement of the deck lid.

Figure 3:
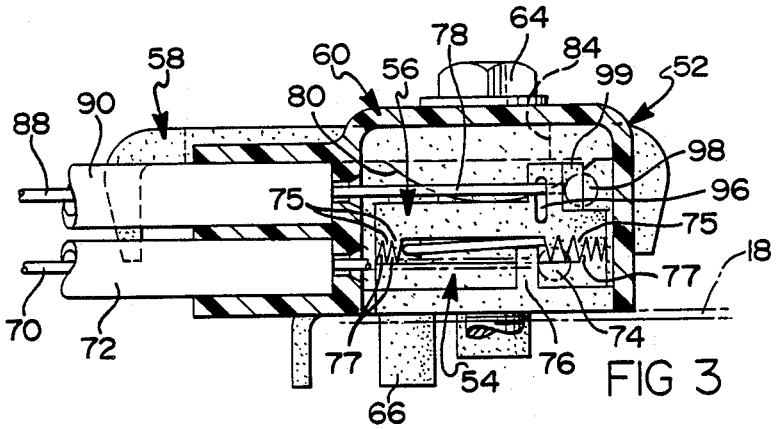
FIG. 3 is a section view taken in the direction of arrows 3—3 of FIG. 1.

As best seen in FIGS. 2 and 3, the molded plastic actuator gear 56 is also rotatably journaled on the support sleeve 62 and Is interposed between the drive gear 54 and the shift bar 58. As seen in FIG. 3, the actuator gear 56 carries a plurality of gear teeth 75 which project axially toward a mating plurality of gear teeth 77 provided on the drive gear 54.

Figure 4:
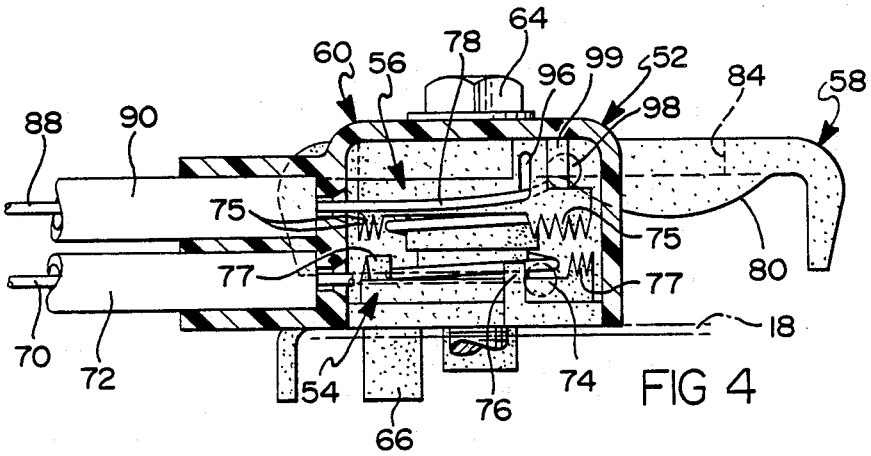
FIG. 4 is a view similar to FIG. 3 but showing the deck lid latch disconnected from the remote release handle.

A coil compression spring 78 is interposed between the drive gear 54 and the actuator gear 56 and acts to urge the gears axially apart. However, as best seen in FIG. 3, the shift bar 58 has a cam surface 80 which engages with the actuator gear 56 to hold the actuator gear 56 in gear meshing engagement with the drive gear 54 against the bias of the spring 78. The shift bar 58, as best seen in FIG. 1, has a elongated aperture 84 which receives the support sleeve 62 of housing 60 to enable back and forth sliding movement of the shift bar 58 between the leftward position of FIG. 3 and the rightward position of FIG. 4. As seen in FIG. 4, the rightward sliding movement of the shift bar 58 carries the cam 80 away from the actuator gear 56 permitting the spring 78 to urge actuator gear 56 axially away from drive gear 54 as shown in FIG. 4.

Referring again to FIG. 1 it is seen that a remote deck lid actuator handle 86 is mounted adjacent the vehicle seat and connected to the deck lid latch by cable 88 enclosed in sheath 90. The cable 88, as best seen in FIGS. 2 and 3 is threaded through a slot 96 in flange 99 of the actuator gear 56 and has a ball 98 swaged on the end thereof so that pulling the cable 88 leftwardly by the release handle 86 rotates the actuator gear 56.

As seen in FIG. 3, the left hand placement of the shift bar 58 retains the actuator lever 56 in gear meshing engagement with the drive gear 54 against the bias of spring 78 urging the gears apart. Accordingly, actuation of the release handle 86 adjacent the occupant seat will pull the cable 88 leftwardly which rotates the actuator gear 56 and also the drive gear 54 which is in gear meshing engagement therewith. The rotation of the drive gear 54 causes its operating arm 66 to engage and pivot the detent lever 32 to unlatch the latch bolt 20.

If the vehicle owner wishes to prevent entry into the luggage compartment by a person having access to the occupant compartment, the shift bar 58 is slid rightwardly to the FIG. 4 position. This rightward movement of the shift bar 58 carries cam 80 out of engagement with the actuator gear 56 so that spring 78 biases the actuator g®ar 56 axially away from the drive gear 54 thereby disengaging the engagement of gear teeth 75 form gear teeth 77. Accordingly, a subsequent lifting of a the r®mote handle 86 Will tension the cable 88 and rotate the actuator gear 56, but the drive gear 54 will not be rotated.

It will be understood that irrespective of the position of the shift bar 58, rotation of the key cylinder 68 by a properly bitted key will tension the cable 70 and rotate the drive gear 54 to release the deck lid latch 10.

Thus it is seen that the invention provides a new and improved deck lid latch wIth remote actuator disconnectable to prevent unauthorized entry into the luggage compartment by a person having access to the passenger compartment.

The embodiments of the invention in which an exclusive property or privilege is claimed are defined as follows:

1. In a vehicle having a luggage compartment lid openable upon release of a latch, and a release handle mounted in the operator compartment and connected to the latch by a cable for releasing the latch upon operator actuation of the release handle, the improvement comprising:

a drive member rotatably mounted on the latch and operable to release the latch, an actuator member rotatably mounted and being rotatable by the cable upon operator actuation of the release handle, gear teeth acting between the actuator member and the drive member so that rotation of the actuator member rotates the drive member, and shift means located inside the luggage compartment and operable to selectively shift one of the members relative the other member to disengage the gear teeth acting therebetween so that operator actuation of the release handle is disconnected from the latch.

2. In a vehicle having a luggage compartment lid openable upon release of a latch, and a release handle mounted in the operator compartment and connected to the latch by a cable for releasing the latch upon operator actuation of the release handle, the improvement comprising:

a drive gear having gear teeth and being rotatably mounted on the latch and operable to release the latch upon rotation thereof, an actuator gear being rotatably mounted on the latch and having gear teeth meshing with the gear teeth of the drive gear, said actuator gear being connected to the cable so that operator actuation of the release handle rotates the actuator gear and the drive gear to release the latch, and shift means located inside the luggage compartment and operable to selectively shift the actuator gear away from the drive gear so the the gear teeth are disengaged and operator actuation of the release handle is disconnected from the latch.

3. In a vehicle having a luggage compartment lid openable upon release of a latch, and a release handle mounted in the operator compartment and connected to the latch by a cable for releasing the latch upon operator actuation of the release handle, the improvement comprising:

a drive gear having gear teeth projecting axially therefrom and being rotatably mounted on the latch and operable to release the latch upon rotation thereof, an actuator gear having gear teeth projecting axially therefrom toward the drive gear and adapted to mesh therewith, said actuator gear being connected to the cable so that operator actuation of the release handle rotates the actuator gear, means mounting the actuator gear on the latch for both rotary movement and axial movement relative to the drive gear and including shift means located inside the luggage compartment and operable to selectively shift the actuator gear axially away from the drive gear so the the gear teeth are disengaged and operator actuation of the release handle is disconnected from the latch.

4. The improvement of claim 3 further characterized by the shift means including spring means urging the actuator gear axially apart from the drive gear and shift bar movably mounted on the latch and slidable between a first position acting against the bias of the spring means to hold the gears in engagement and a second position permitting the spring means to disengage the actuator gear from the drive gear.

5. In a vehicle having a luggage compartment lid openable upon release of a latch, and a release handle mounted in the operator compartment and connected to the latch by a cable for releasing the latch upon operator actuation of the release handle, the improvement comprising:

a molded plastic housing mounted on the latch, a drive gear rotatably mounted on the housing and having an operating arm engageable with the latch and operable to release the latch upon rotation thereof, an actuator gear rotatably mounted on the housing and being rotatable by the cable upon operator actuation of the release handle, gear teeth acting between the actuator member and the drive member so that rotation of the actuator member rotates the drive member, and operator actuatable shift means mounted on the housing and located inside the luggage compartment and operable to selectively shift one of the actuator gear relative the drive gear to disengage the gear teeth acting therebetween so that operator actuation of the release handle is disconnected from the latch.

6. In a vehicle having a luggage compartment lid openable upon release of a latch, and a release handle mounted in the operator compartment and connected to the latch by a cable for releasing the latch upon operator actuation of the release handle, the improvement comprising:

a molded plastic housing mounted on the latch, a drive gear rotatably mounted on the housing and operable to release the latch upon rotation thereof, a key operated mechanism operable to rotate the drive gear to release the latch, an actuator gear rotatably mounted on the housing and being rotatable by the cable upon operator actuation of the release handle, gear teeth acting between the actuator member and the drive member so that rotation of the actuator member rotates the drive member, and operator actuatable shift means mounted on the housing and located inside the luggage compartment and operable to selectively shift one of the actuator gear relative the drive gear to disengage the gear teeth acting therebetween so that operator actuation of the release handle is disconnected from the latch.

* * * * *